US005908246A

United States Patent [19]

Arimura et al.

[11] Patent Number: 5,908,246

[45] Date of Patent: Jun. 1, 1999

[54] UNSEALING STRUCTURE WITH CUT OUT FOR SHRINK FILM SEALED PACKAGES

[75] Inventors: Yoshiharu Arimura; Youichi Sakurai, both of Kanagawa, Japan

[73] Assignee: Komatsu Electronic Metals Co., Ltd., Kanagawa, Japan

[21] Appl. No.: 08/923,912

[22] Filed: Sep. 5, 1997

[30] Foreign Application Priority Data

Sep. 7, 1996 [JP] Japan ..... 8-272813

[51] Int. Cl.[6] ..... B65D 65/26

[52] U.S. Cl. ..... 383/205; 229/123.2; 229/138; 383/66; 383/200; 383/207

[58] Field of Search ..... 383/66, 200, 203, 383/205, 207, 208; 229/123.2, 138, 924, 87.05

[56] References Cited

U.S. PATENT DOCUMENTS

| | | | |
|---|---|---|---|
| 2,653,744 | 9/1953 | Behr | 383/205 X |
| 4,192,420 | 3/1980 | Worrell, Sr. et al. | 383/207 X |
| 4,650,079 | 3/1987 | Tani | 383/66 X |
| 4,679,693 | 7/1987 | Forman | 383/203 |
| 4,739,879 | 4/1988 | Nakamura | 383/205 X |
| 4,777,054 | 10/1988 | Greenhouse | 229/87.05 X |
| 4,811,848 | 3/1989 | Jud | 383/205 |
| 4,848,575 | 7/1989 | Nakamura et al. | 383/66 X |
| 5,050,742 | 9/1991 | Muckenfuhs | 383/207 X |

FOREIGN PATENT DOCUMENTS

| | | | |
|---|---|---|---|
| 474648 | 11/1937 | United Kingdom | 229/87.05 |

*Primary Examiner*—Jes F. Pascua
*Assistant Examiner*—Robin A. Hylton
*Attorney, Agent, or Firm*—Sughrue, Mion, Zinn, Macpeak & Seas, PLLC

[57] ABSTRACT

An unsealing structure for packing films that are difficult to rip to pack merchandise is disclosed, where the films can be easily ripped by stripping a tag label. A tearing line 2 is formed in the surface of the film 1 of the film package by hot shearing. A cutout 3 communicates with the tearing line 2 to assist in unsealing the film package. A tag label 4 is affixed to the film 1 and covers the tearing line 2 and the cutout 3.

16 Claims, 5 Drawing Sheets

UNSEALING STRUCTURE WITH CUT OUT FOR SHRINK FILM SEALED PACKAGES

BACKGROUND OF THE INVENTION

1. Field of the Invention

This invention relates to an unsealing structure for shrink film sealed packages within which a piece of merchandise is enclosed by a film and a tag seal is affixed to the outer surface of the film.

2. Description of Prior Art

Measures for unsealing a shrink film sealed package within which a piece of merchandise is enclosed by a shrink film has been disclosed in the Japanese Publication Gazette JITSU KOU HEI No. 1-34215 entitled "STRUCTURE FOR PREVENTING RELABELING OF A TAG LABEL AFFIXED TO PACKAGES". In the above publication, a tearing line is formed beforehand in a certain portion of the film, and a tag label such as a bar code is affixed thereto. If the tag label is stripped off, then the portion of the film near the tearing line will remain adhered to the tag label and the film of the package will be easily ripped beginning along the tearing line. The above unsealing structure is well known and often used in packages of instant cup noodles, where polyvinyl resins are chosen as the material to comprise shrink films for ease of ripping.

However, some polyvinyl resins produce poisonous substances when they are burned. For the sake of protecting the clean environment, it is preferable to use polyethylene films.

However, polyethylene film possesses very good extendibility, even in the case having the above unsealing structure, the portion of the film near the tearing line extends only when it is desired to rip the film of the package along the tearing line. Thus, it is difficult to rip the film of the package along the tearing line occasionally.

Especially, in the case of packing semiconductor wafers by utilizing films which are thicker than those with very small thickness and used in the package of instant cup noodles, it is quite difficult to rip the polyethylene film of the package along the tearing line.

SUMMARY OF THE INVENTION

In view of the above defects, the object of the present invention is to provide an unsealing structure for shrink film sealed packages, which can be easily ripped by stripping off tag labels even using films that are quite difficult to tear.

To achieve the above object, according to this invention, an unsealing structure for shrink film sealed packages is provided, in which a tag label is affixed to the packing film of a merchandise and a tearing line is formed in the portion where the tag label is affixed to, and part of the film is ripped beginning along the tearing line when the tag label is stripped off. The unsealing structure is characterized in that at least a cutout communicating with the tearing line is formed in the film.

Furthermore, at least a cutout adjacent to the tearing line is formed in the film.

In conventional cases, because polyethylene resins are easy to extend but difficult to rip, it is difficult to rip unsealing structures using polyethylene resins as shrink films for film packages. According to this invention, a cutout is added and ripping the film beginning from the cut out becomes easy.

Furthermore, to prevent ripping incurred by shrinkage of the film beginning from the cutout formed therein during product transportation, it is necessary to keep a tag label affixed to the periphery of the cutout.

In the process of stripping off the tag label, even if the film can be ripped in the stripping direction, it is difficult to rip the film in the direction opposite to the stripping direction due to the extendibility of the film. According to this invention, a cutout is formed in the direction opposite to the stripping direction so as to rip the film in both directions beginning along the tearing line.

Furthermore, to make the ripping of the film easy, the cutout is preferably narrow and sharp. However, in conventional cases, forming a cutout is performed by hot shearing which will cause melting of the periphery of the portion in contact with the tool, this makes it difficult to reform the melted portion into a narrow and sharp shape. According to this invention, it is preferable to form the cutout by a sharp tool without using hot shearing. The tearing line is penetrated through the whole thickness of the package film.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENTS

FIRST EMBODIMENT

Figure 1:
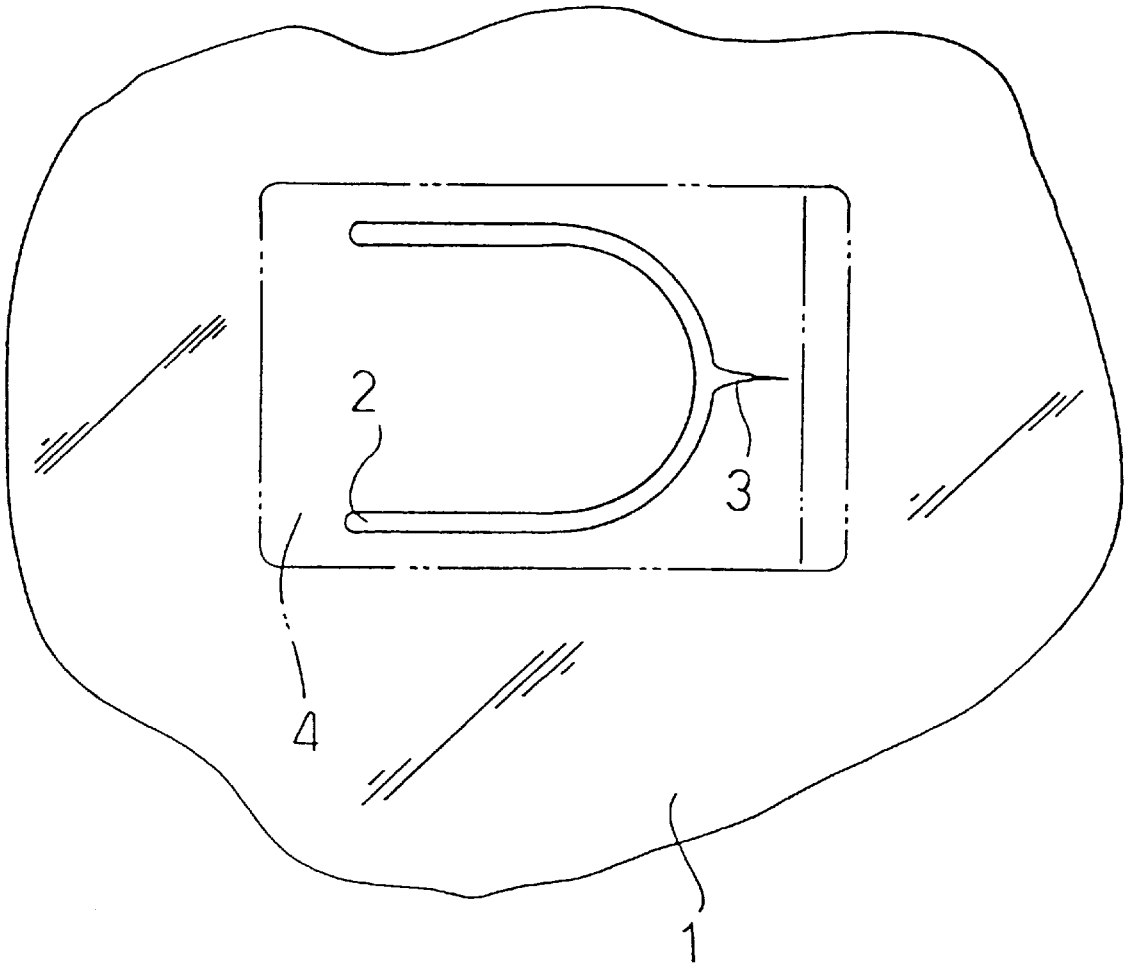
FIG. 1 is a top view showing an unsealing structure of the first embodiment according to this invention.
Figure 2A:
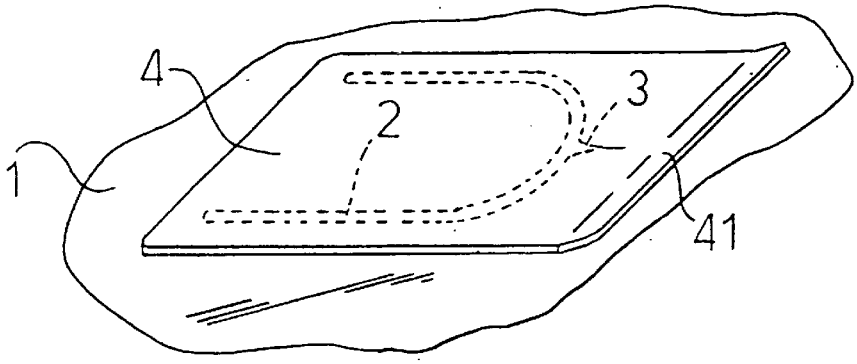
FIGS. 2A–2C are partial perspective views showing the method for opening the unsealing structure formed in a film package of the first embodiment according to this invention.
Figure 2B:
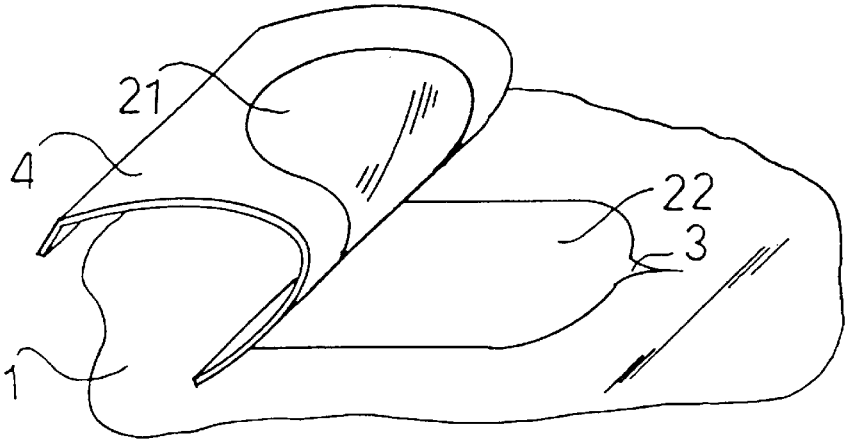
Figure 2C:
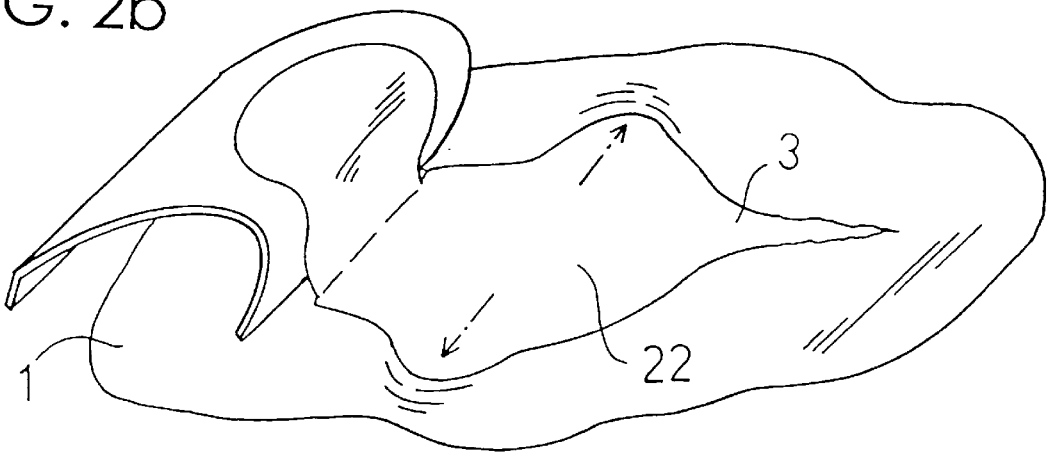

FIG. 1 is a top view showing an unsealing structure of the first embodiment. FIGS. 2*a*–2*c* are partial perspective views showing the method for opening the unsealing structure formed in a shrink film sealed package of the first embodiment.

As shown in FIGS. 1 and 2(*a*), the unsealing structure of the first embodiment consists of a tearing line 2 formed on the surface of the film 1 of the film package by hot shearing; a cutout 3 communicating with the tearing line 2; a tag label 4 affixed to the film 1 and covering the tearing line 2 and the cutout 3. The tearing line 2 is formed in a "U" shape and the cutout 3 located at the bottom of the "U" shape is formed by using a sharp tool (not shown).

As shown in FIG. 2(*a*), at first, the portion 41 of the tag label 4 not adhering to the film is held and pulled up to strip the tag label 4 off the film 1. At that time, as shown in FIG. 2(*b*), same as conventional unsealing structures, the portion 21 surrounded by the tearing line 2 is raised and remains adhered to the tag label 4, thus creating an opening 22.

As shown in FIG. 2(*c*), by inserting fingers of two hands into and enlarging the opening 22, the film 1 can be easily ripped beginning from the cutout 3 so as to unseal the film package.

SECOND EMBODIMENT

Figure 3:
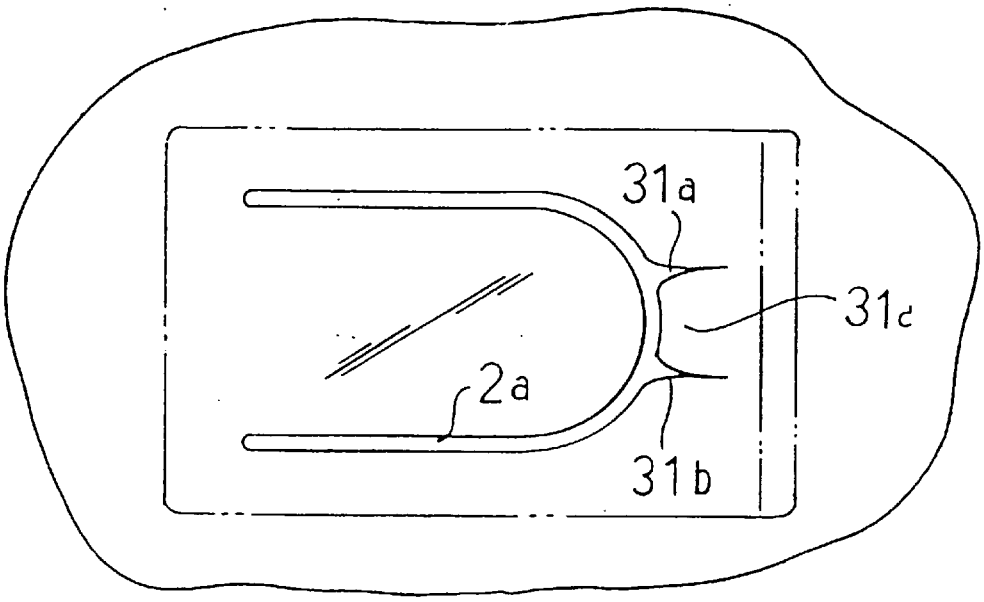
FIG. 3 is a partial top view showing an unsealing structure of the second embodiment according to this invention.

FIG. 3 is a partial top view showing an unsealing structure of the second embodiment.

As shown in FIG. 3, in the unsealing structure of the second embodiment, two substantially parallel cutouts 31*a*, 31*b* communicate with the bottom of the "U" shaped tearing line 2*a* formed in the film 1. By this arrangement, a tag portion 31*c* is formed between the cutout 31*a* and the cutout 31*b*, and nipping and pulling up the tag portion 31*c* can facilitate the ripping of the film 1.

THIRD EMBODIMENT

Figure 4:
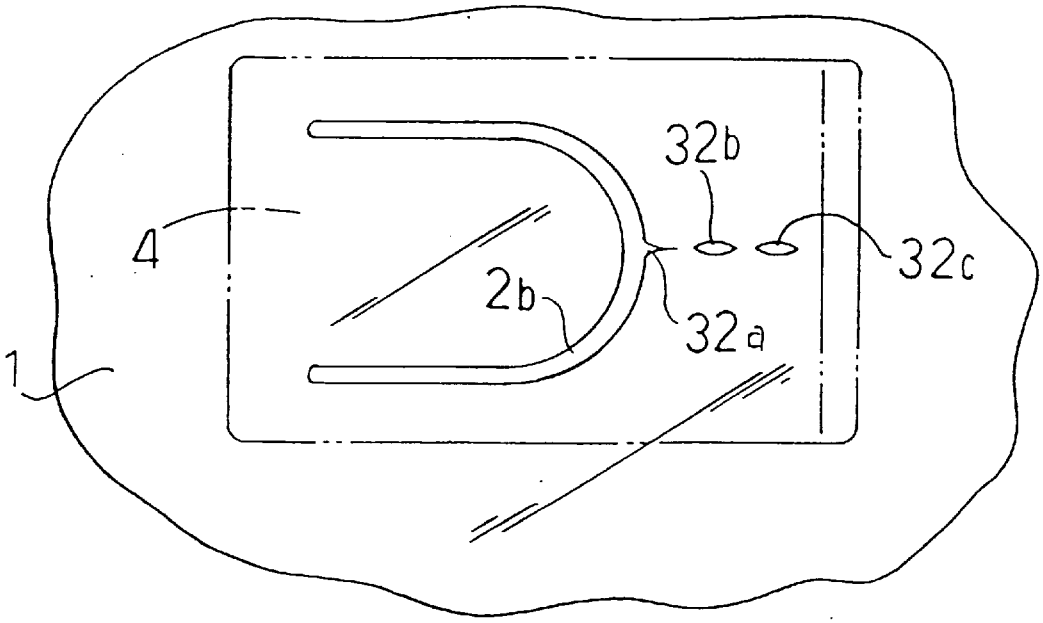
FIG. 4 is a partial top view showing an unsealing structure of the third embodiment according to this invention.
Figure 5:
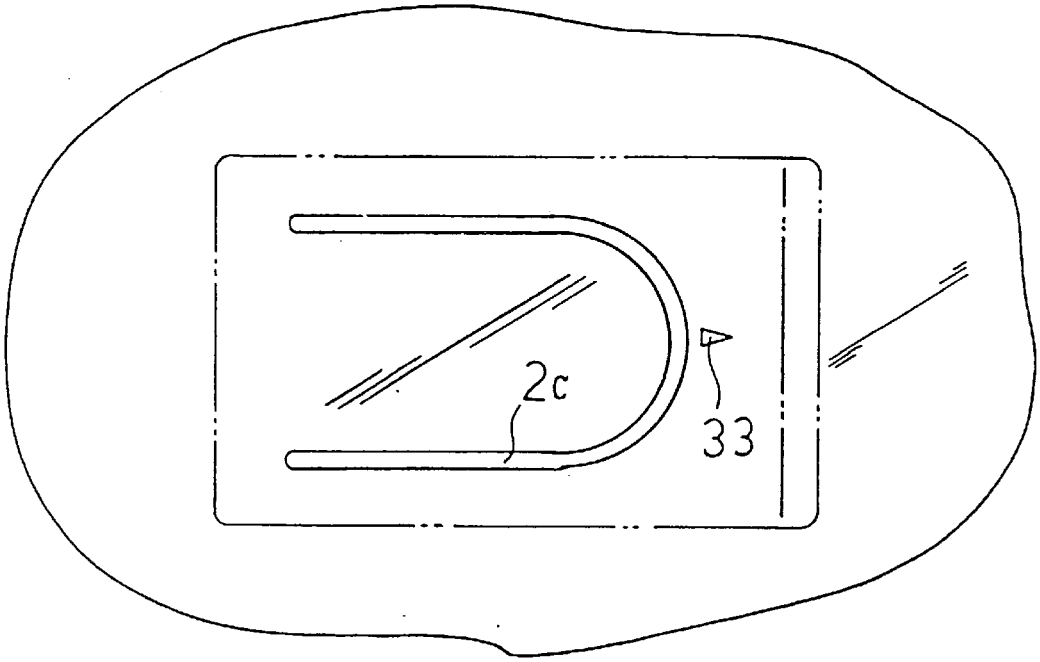
FIG. 5 is a partial top view showing an unsealing structure of another embodiment relating to the third embodiment of this invention.

FIG. 4 is a partial top view showing an unsealing structure of the third embodiment. FIG. 5 is a partial top view showing an unsealing structure of another embodiment relating to the third embodiment of this invention.

For the purpose of easily unsealing the film package, the length of the cutout of this invention is preferably extensive, however, it is restrained by the size of the tag label. To prevent ripping during product transportation, in the unsealing structure of the third embodiment, the cutouts are formed in dotted line to maintain the strength of the film.

In other words, as shown in FIG. 4, a short cutout 32*a* communicates with the tearing line 2*a*, and a plurality of cutouts 32*b*, 32*c* are formed in a dotted line along its extending line.

In the process of affixing the tag label 4, it is desired to prevent dropping of the film 1 near the short cutouts 32*b*, 32*c*, toward the inside of the package.

For some films with altered thickness or made of special materials, the same effect can be obtained by forming a cutout 33 near the tearing line 2*c* (see FIG. 5) without communicating the cutout 33 with the tearing line 2*c*. By this arrangement, the strength of the portion near the cutout 33 can be maintained and unintentional ripping during product transportation can be avoided.

FOURTH EMBODIMENT

Figure 6:
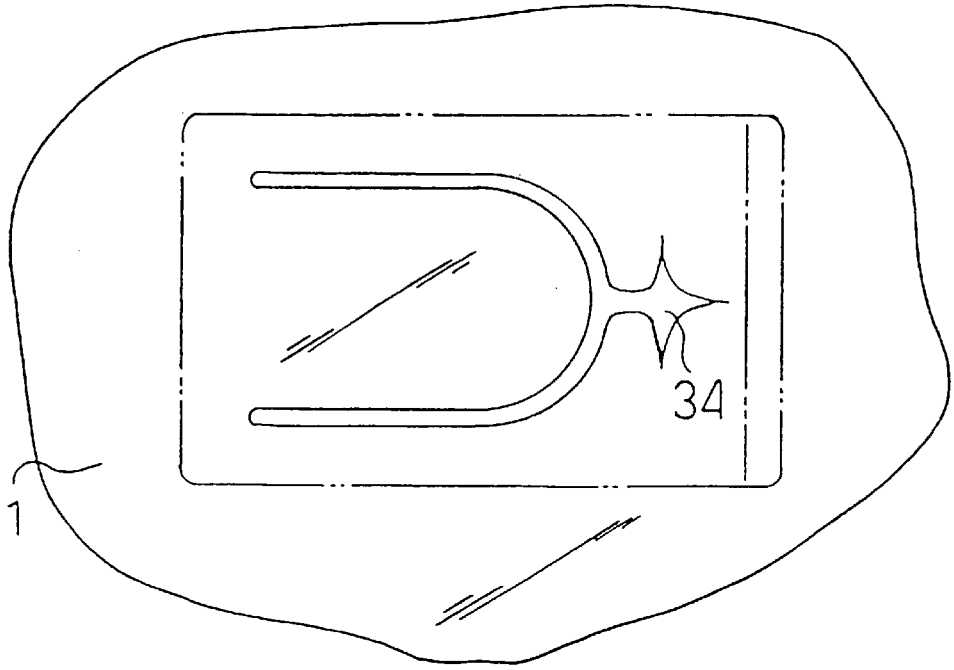
FIG. 6 is a partial top view showing an unsealing structure of the fourth embodiment according to this invention.

FIG. 6 is a partial top view showing an unsealing structure of the fourth embodiment.

As shown in FIG. 6, in the unsealing structure of the fourth embodiment, the cutout 34 is formed in a cross shape. By this arrangement, the film 1 can be ripped along multiple directions, thus enhancing the operation efficiency and the flexibility in relation to the quality of the film.

FIFTH EMBODIMENT

Figure 7:
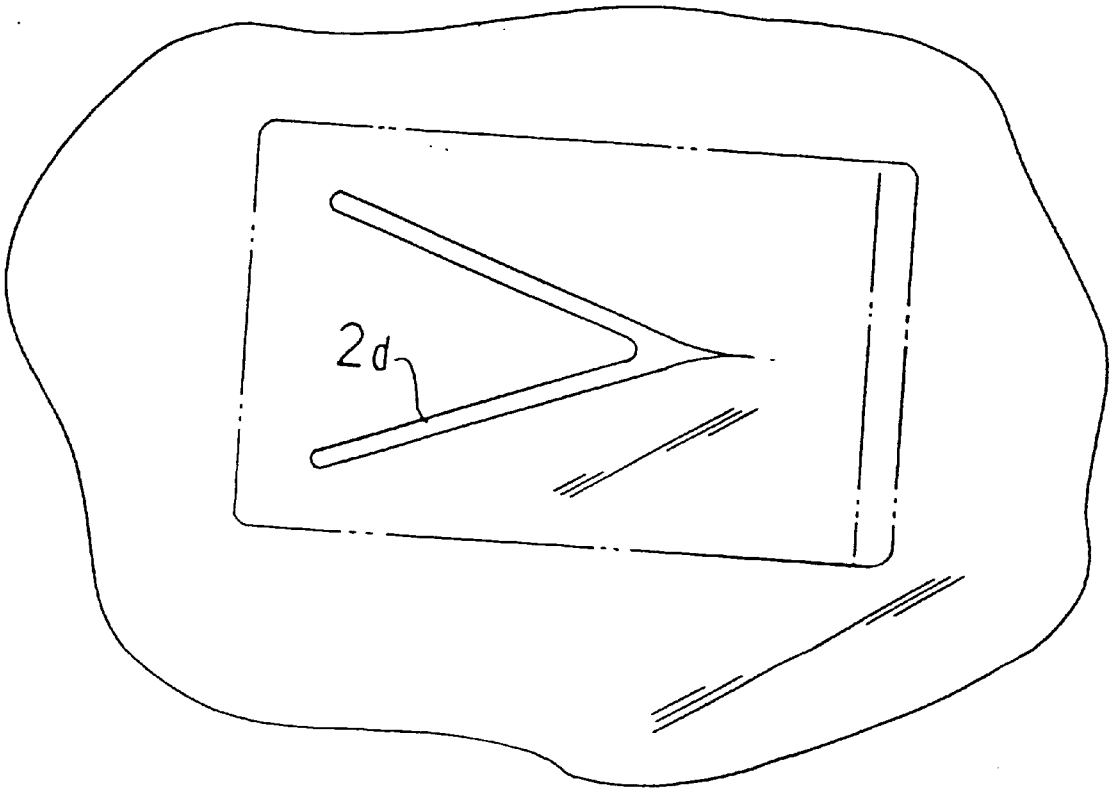
FIG. 7 is a partial top view showing an unsealing structure of the fifth embodiment according to this invention.

FIG. 7 is a partial top view showing an unsealing structure of the fifth embodiment.

In the first embodiment to the fourth embodiment, the tearing lines were formed in a "U" shape, however, this invention is not limited to the above. It works well if the cutouts are communicated with or located near the tearing line. Therefore, the same effect can also be obtained by forming, for example, a "V" shaped tearing line 2*d*.

The structures according to this invention have been explained as above, in the cases of utilizing polyethylene films, which are difficult to rip, to pack merchandise, wherein the polyethylene films can be easily ripped from a cutout exposed immediately after the stripping of a tag label.

What is claimed is:

1. A film package containing a piece of merchandise enclosed by a packing film, the film package comprising an unsealing structure and a tag label adhered to the packing film, the unsealing structure comprising:

a tearing line formed in the package film; and a cutout communicating with and extending from the tearing line, the cutout being formed in the packing film;

wherein the tag label covers the tearing line and the cutout such that when the tag label is stripped off the film package, the packing film is ripped away with the tag label beginning at the cutout and then along the tearing line.

2. The film package as claimed in claim 1, wherein the cutout is a cutting portion formed by a sharp tool without using hot shearing.

3. The film package as claimed in claim 1, wherein the tearing line is formed in a substantially "U" shape and the cutout is formed at a bottom of the substantially "U" shape.

4. The film package as claimed in claim 1, wherein the packing film comprises polyethylene resin.

5. The film package as claimed in claim 1, wherein the tearing line is in a shape of a "V", and the cutout is communicated with a sharp bottom edge of the "V", and extends to an opposite direction.

6. The film package as claimed in claim 1, wherein the tag label includes a first portion which is not adhered to the packing film and a second portion which is adhered to the packing film and covers the tearing line, and when said first portion of the tag label is pulled to strip the tag label off the packing film, said second portion of the tag label which covers the tearing line is raised and remains adhered to the tag label, forming an opening such that a user can manually enlarge said opening, and the packing film can be ripped away beginning at the cutout to unseal the film package.

7. A film package containing a piece of merchandise enclosed by a packing film, the film package comprising an unsealing structure and a tag label adhered to the packing film, the unsealing structure comprising:

a tearing line formed in the package film; and a cutout adjacent to and spaced apart from the tearing line, the cutout being formed in the packing film;

wherein the tag label covers the tearing line and the cutout such that when the tag label is stripped off the film package, the packing film is ripped away with the tag label beginning at the cutout and then along the tearing line.

8. The film package as claimed in claim 7, wherein the cutout is a cutting portion formed by a sharp tool without using hot shearing.

9. The film package as claimed in claim 7, wherein the tearing line is formed in a substantially "U" shape and the cutout is formed at a bottom of the substantially "U" shape.

10. The film package as claimed in claim 7, wherein a plurality of cutouts are formed in a dotted line shape in a ripping direction of the packing film.

11. The film package as claimed in claim 7, wherein the packing film comprises polyethylene resin.

12. A film package provided with an unsealing structure, comprising:

a packing film enclosing a piece of merchandise;

a tag label adhered to the packing film;

a tearing line formed in the packing film;

a cutout communicating with and extending from the tearing line formed in the package film;

wherein the tag label covers the tearing line and the cutout such that when the tag label is stripped off the film package, the packing film is ripped away with the tag label beginning at the cutout and then along the tearing line.

13. The film package as claimed in claim 12, wherein the cutout is a cutting portion formed by a sharp tool without using hot shearing.

14. The film package as claimed in claim 12, wherein the tearing line is formed in a substantially "U" shape and the cutout is formed at a bottom of the substantially "U" shape.

15. The film package as claimed in claim 12, wherein the packing film comprises polyethylene resin.

16. The film package as claimed in claim 12, wherein the tearing line is in a shape of a "V", and the cutout is communicated with a sharp bottom edge of the "V", and extends to an opposite direction.

* * * * *